United States Patent [19]

Cuevas

[11] 4,232,902

[45] Nov. 11, 1980

[54] SOLUTION MINING WATER SOLUBLE SALTS AT HIGH TEMPERATURES

[75] Inventor: Ephraim A. Cuevas, Corpus Christi, Tex.

[73] Assignee: PPG Industries, Inc., Pittsburgh, Pa.

[21] Appl. No.: 10,563

[22] Filed: Feb. 9, 1979

[51] Int. Cl.[2] ..... E21C 41/08

[52] U.S. Cl. ..... 299/4; 299/5

[58] Field of Search ..... 166/272; 299/4, 5, 6

[56] References Cited

U.S. PATENT DOCUMENTS

| | | | |
|---|---|---|---|
| 2,161,800 | 6/1939 | Cross | 299/4 |
| 3,050,290 | 8/1962 | Caldwell et al. | 299/4 |
| 3,148,000 | 9/1964 | Dahns et al. | 299/4 |
| 3,278,234 | 10/1966 | Helvenston et al. | 299/4 |
| 3,284,137 | 11/1966 | Wolber | 299/5 |
| 3,294,167 | 12/1966 | Vogel | 166/272 |
| 3,348,883 | 10/1967 | Jacoby | 299/4 |
| 4,074,754 | 2/1978 | Christian | 166/245 |

*Primary Examiner*—William F. Pate, III

*Attorney, Agent, or Firm*—Walter M. Benjamin

[57] ABSTRACT

Subterranean formations of water soluble salt deposits are solution mined by introducing into the formation an aqueous solvent having a temperature substantially above the temperature of the deposit thereby heating the deposit and dissolving the soluble salts, and withdrawing from the deposit an aqueous solution enriched in the dissolved salts. An aqueous solvent having a temperature lower than the temperature of the first solvent is subsequently introduced into the deposit thereby recapturing heat given up to the deposit and dissolving the soluble salt utilizing greater solubility characteristics of the soluble salts owing to the increased deposit temperature, and withdrawing from the deposit a substantially increased amount of dissolved salt.

26 Claims, 3 Drawing Figures

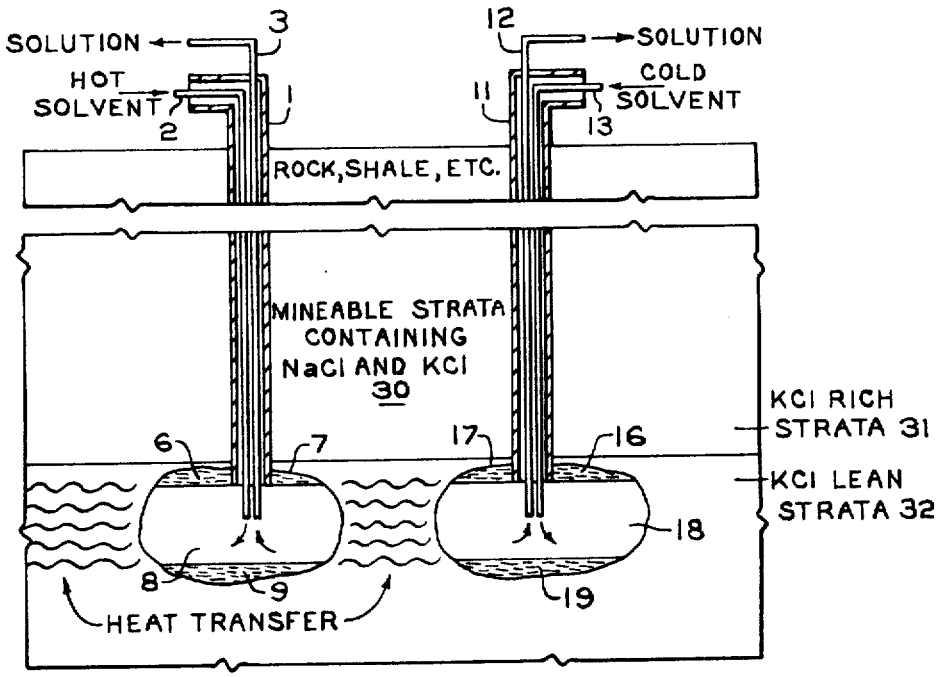
FIG. 1
FIG. 3
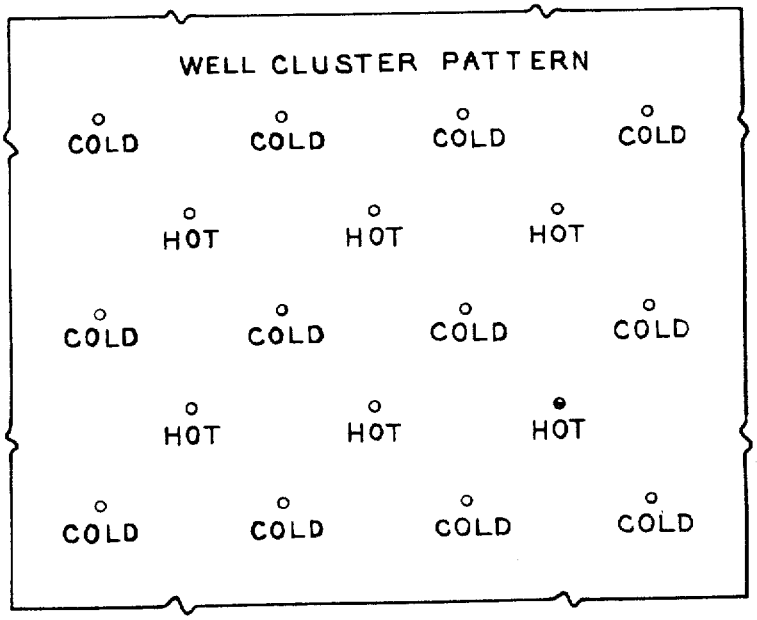

SOLUTION MINING WATER SOLUBLE SALTS AT HIGH TEMPERATURES

BACKGROUND OF THE INVENTION

1. Field of the Invention

This invention relates to solution mining of subterranean formations of water soluble salt deposits utilizing a solvent at high temperatures thereby heating the formation and recapturing heat given up thereto. It more particularly relates to solution mining of subterranean formations of soluble salt deposits which have increasing solubilities and increasing rates of dissolution with increasing temperatures, e.g., potassium chloride.

2. Description of the Prior Art

Subterranean deposits of water soluble salts have been solution mined by introducing an aqueous solvent through one or more boreholes communicating with the deposit and withdrawing a solution enriched in the dissolved salt. A cavity is created thereby and begins to grow as larger surface areas of the deposit are exposed to the solvent which in turn dissolves more soluble salt until the cavity becomes so large that the soluble salt can no longer be extracted at commercially attractive rates or surface subsidence becomes a risk. Salts such as sylvinite, trona, and halite have been extracted from subterranean deposits employing this technique.

It is often advantageous to extract these soluble salts using aqueous solvents hotter than the deposit to effect relatively rapid extraction rates as well as to provide a solvent having a greater capacity than a cooler solvent. For example, U.S. Pat. No. 2,161,800 to Cross teaches solution mining of potassium compounds by circulating through underground potash beds super heated water or brine unsaturated with respect to the potassium compounds at temperatures of about 200° C. or above. While this method uses high temperature solvents which have the benefit of causing the potassium compounds to be extracted relatively rapidly, there is no provision in the method to recover the heat transferred to the underground potash beds. Thus, since potash beds are relatively highly heat conducting, a sizable expense is incurred in heat loss thereto.

U.S. Pat. No. 3,050,290 to Caldwell teaches a method of circulating a solvent through an underground trona formation which is thereby heated to between 50° C. and about 200° C. by heating the solvent before each cycle. A portion of the circulating solvent is bled from the system for purposes of extracting sodium values therefrom. This method minimizes the amount of heat necessarily supplied to heat up the solution in the passage or cavity and to heat the surrounding trona formation, but again, no provision is made to recover heat loss to the formation by transient conduction. Therefore, the cost for the substantial and rapid heat input required to bring the solution and surrounding cavity to the desired dissolving temperature is never recaptured.

U.S. Pat. No. 3,278,234 to Helvenston teaches a method of solution mining potassium chloride by feeding solvent between 50° C. and 100° C. into a subterranean potassium chloride and sodium chloride bearing deposit without losing heat by maintaining withdrawn enriched solution within 15° C. of the matural deposit temperature. However, this method does not have the advantage of increased potassium chloride dissolution at temperatures substantially higher than the natural formation temperature. Consequently, there is a compromise in the amount of potassium chloride mined per unit volume of solvent used.

U.S. Pat. No. 3,348,883 to Jacoby teaches the concomitant solution mining and refining of soluble minerals, such as sodium chloride ore containing sulfates as an impurity, by utilizing a high temperature geological environment to satisfy the heat source requirement to selectively exclude the sulfates during mining. This method does not involve introducing heat into the soluble mineral deposits beneath the earth's surface, hence any inefficiency in heat utilization does not result in a sizable loss in energy costs. However, the geological environment of most subterranean soluble salt deposits is not conducive to this method. Thus, the application of this method is limited.

U.S. Pat. No. 4,074,754 to Christian teaches a method of producing geothermal energy and/or minerals from subterranean reservoirs at about 600° F. and containing up to 250,000 ppm salt content by injecting into the reservoir a low salinity water at ambient surface temperature. The injected water is allowed to become heated after which water is withdrawn from the reservoir containing heat energy and minerals. Here again, the application of this method is limited as is the Jacoby method described above.

It is therefore a desideratum that subterranean soluble salt deposits be recovered using a high temperature solvent whereby heat lost to the subterranean deposit can be somehow recaptured.

SUMMARY OF THE INVENTION

It has been discovered that an aqueous solvent between about 40° C. and 135° C. or higher can be utilized to solution mine subterranean formations rich in water soluble salt deposits without losing irretrievable heat to the formation. In accordance with this discovery, an aqueous solvent having a temperature substantially higher than the temperature of the formation is introduced into the formation imparting heat thereto causing the soluble salt to be rapidly extracted by the hot solvent. A highly enriched solution is withdrawn from the formation owing to the solvent having an increasing dissolving rate and/or capacity with increasing temperatures. Before heat imparted to the formation is too greatly dissipated, a solvent having a temperature lower than the first solvent is subsequently or simultaneously introduced into the formation, which supplies heat, thereby aiding the lower temperature solvent to further extract the salt. A solution is then withdrawn from the deposite commensurate with its increased temperature.

The benefits of this invention are numerous. First, the invention is not limited to recovering salts having a solubility that increases with increasing temperatures. For virtually all salts, a solvent having a higher temperature has a greater dissolving rate. Thus, a hot solvent can be circulated through a subterranean formation rich in salt deposits at a faster rate than a cooler solvent extracting the same amount of salt. Second, where there is a mixture of salts, one of which having a greater solubility at higher temperatures than the solubility of other principal salts in the mixture, the hot solvent can selectively mine the salt with the greater solubility. For example, hot solvent extracts sodium chloride from a subterranean formation of sodium chloride and sulfate deposits at the exclusion of sulfates, thereby yielding an essentially pure sodium chloride solution. The subsequently fed cooler solvents extracts sodium chloride to the exclusion of sulfates to a lesser extent, but heat that could be potentially lost to the formation is recovered by the cooler solvent.

The benefits of the invention are best utilized in the recovery of potassium chloride from salt deposits of potassium chloride/sodium chloride mixtures. The invention is utilized (1) in mining selectively some potassium chloride to the exclusion of some sodium chloride, when the solvent is a solution saturated with respect to sodium chloride, (2) in mining at faster flow rates, and (3) in mining deposits having relatively lower potassium chloride content. Heat of the solvent which is not imparted to the formation but contained in the withdrawn solution enhances above surface refinery processes. A solution having a relatively higher overall potassium chloride content is realized utilizing the hotter solvent, while heat loss is reduced when subsequently utilizing the cooler solvent.

In a preferred embodiment of the present invention, the formation is maintained to within 15° C. of its natural (undisturbed) temperature by supplying only enough heat by the hotter solvent for subsequent mining with the cooler solvent. Thus, the temperature of the formation would appear undisturbed within 15° C.

BRIEF DESCRIPTION OF THE DRAWINGS

Additional benefits and advantages of the present invention will become apparent by the detailed description made with reference to the drawings in which:

FIG. 1 is a diagram which illustrates two (2) subterranean cavities in a mineable strata containing potassium chloride and sodium chloride where one cavity acts as a heat source and the other cavity acts as a heat sink. Each cavity has one cased well bore through which solvent is introduced and withdrawn;

FIG. 3 is a diagram which illustrates an aerial view of a cavity pattern with respect to which cavities are fed hot and cold solvents.

DETAILED DETAILED DESCRIPTION OF THE INVENTION

Figure 2:
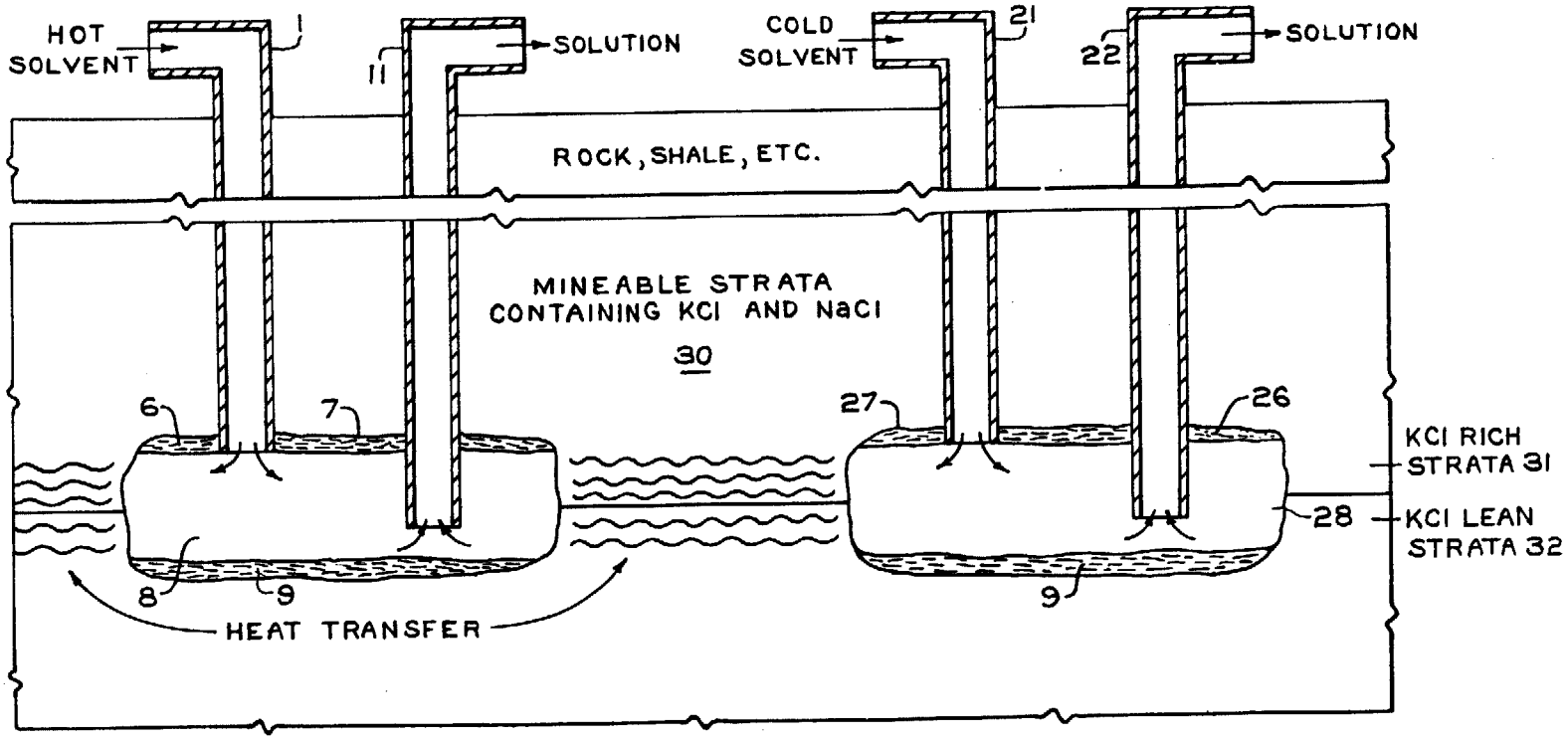
FIG. 2 is a diagram which illustrates two (2) subterranean cavities in a mineable strata as in FIG. 1 except each cavity has two cased well bores, one through which solvent is introduced and the other through which solution is withdrawn.

According to the present invention a subterranean formation of water soluble salt deposits is mined with a solvent having a temperature higher than that of the formation and heat imparted thereby to the formation is regained by subsequently mining with a solvent having a temperature lower than that of the first solvent. Both solvents are withdrawn from the deposit enriched in dissolved soluble salt. While the method of the present invention is applicable generically to (1) soluble salt mixtures conducive to mining more selectively at increasing temperatures because at least one salt in the mixture has an increasing solubility, e.g., potassium chloride, magnesium chloride, trona, and the like, and/or (2) soluble salts having increasing dissolving rates at increasing temperatures, e.g., sodium chloride, potassium chloride and most other salts, the present invention will be described with reference to solution mining potassium chloride from salt deposits containing potassium chloride, sodium chloride, and minor amounts of water soluble and insoluble impurities.

Accordingly, an aqueous solvent unsaturated with respect to potassium chloride and having a temperature higher than that of the deposit is fed into the deposit thereby creating a cavity. The solvent is fed between about 5° C. and 50° C. above the natural formation temperature which, for example, range from about 35° C. to 85° C. for depths of about 600 to 2500 meters. The solvent temperature is determined so that it supplies enough heat which is to be consumed by three (3) factors. First, it supplies the heat of dissolution of the potassium chloride, including the potassium chloride required to increase the saturation of the solution in the cavity. Second, it supplies heat to raise and maintain the temperature of the solution in the cavity. Third, it supplies heat which is absorbed by the formation, mostly through the walls of the cavity and to a lesser extent through the roof and to an even lesser extent, through the floor. Accordingly, the temperature of the solvent is preferably high enough to satisfy the aforesaid heat requirements but not so high that its associated vapor pressure otherwise would make its use prohibitive.

The rate at which the solvent is circulated through the cavity depends upon the potassium chloride content of the ore in the cavity while the duration it is circulated before heat is recaptured depends upon the heat conductivity of the formation and the manner in which heat imparted to the formation is recaptured. Generally, if the potassium chloride content is low, the solvent should be circulated through the deposit slowly; if the potassium chloride content is high, the solvent should be circulated more rapidly so that the resulting solution is withdrawn from the cavity enriched in potassium chloride. Since the heat conductivity of the formation varies owing to relative salt compositions, density and moisture content thereof, generally (with other factors equal) a high heat conducting formation should be fed fast for a relatively short length of time; a lower heat conducting formation should be fed slowly for a longer length of time. Other criteria to be considered include the aqueous solvent composition, the formation salt composition, the desired cavity shape, and the method of heat recapture.

The circulation duration is chosen so that heat is imparted to the formation thereby heating the formation substantially above its natural temperature. The essence of the present invention resides in heating the formation which in turn heats a subsequently fed solvent whereby greater solubility characteristics of both solvents for their respective temperature are gained. Thus, it is preferred that the formation is supplied enough heat for the subsequently fed cooler solvent to satisfy the heat of dissolution of potassium chloride and to maintain the temperature of the solution in the cavity such that the net formation temperature is maintained within 15° C. of its natural (undisturbed) temperature. Of course, the formation may be heated to a lesser extent, whereby lesser solubility characteristics of the solvents are realized and whereby the temperature of the subsequently fed solvent must be higher. Nonetheless, there is an advantage in the present invention so long as the value of additional potassium chloride recovered, owing to the higher solvent temperature utilized, exceeds the value of heat irretrievably lost to the formation. Hence, the formation may be heated as low as about 2° C. with no upper limit but preferably between 2° C. and about 15° C. above its natural temperature.

A lower temperature solvent is fed into the heated formation thereby using the heat of the formation to satisfy at least a portion of the aforedescribed requirements thereby dissolving a substantially increased amount of potassium chloride over that which would be dissolved if the formation had not been heated. The solution in the cavity is continually cooled by the lower temperature solvent which continually recaptures heat from the formation. However, the formation should only be cooled until the net formation temperature is within 15° C. of its natural temperature. Hence, the temperature of the solvent, the rate at which it is fed into the cavity, and its salt composition should be such that too much heat is not consumed from the formation.

The time which is allowed to elapse during feeding the heating solvent and before the lower temperature solvent is fed into the cavity is critical to the amount of heat recaptured. Since the heat flows from a hot cavity and flows from a hot conduit communicating therewith, it may be irretrievably dispersed into the formation. It is therefore necessary that heat is recaptured before that time occurs. Of course, this depends upon the many aforesaid heat conductivity factors, but generally the time between cavity initiation or development with a heating solvent and heat recapture by the lower temperature solvent is about 3 to 24 months for a formation containing sylvinite and a minor amount of impurities. Whether the longer or shorter time is used can depend on the method of heat recapture utilized.

In one method of heat recapture, the lower temperature solvent is fed into a same bore hole and a same cavity developed by the heating solvent. This method has the advantage of recapturing heat given up to the formation in all directions. Hence, heat lost to the formation around the conduit, to the walls, roof, and floor of the cavity can be readily recaptured. Since heat flows at different rates through the conduit or walls than the floor or roof, both of the latter of which are somewhat insulated as herein described, it is preferred that the lower temperature solvent is fed into the cavity at a time to recapture the most heat through the conduit and the walls of the cavity through both mediums of which most heat is transferred.

Hence, heating solvent and cooling solvent can be alternately fed into the cavity thereby extracting potassium chloride therefrom until the cavity is large enough to be inactivated. After the cavity is heated by the heating solvent last fed, then the lower temperature solvent, a solution saturated with sodium chloride, is fed into the cavity to selectively mine potassium chloride at a slow rate; i.e., allow the lower temperature solvent to stand about 3-13 months, after which it is withdrawn having recaptured heat of the formation and having been enriched in potassium chloride.

In an alternate method of recapturing heat by introducing the lower temperature solvent into the same cavity developed by the heating solvent, the cavity is developed using methods of U.S. Pat. No. 3,148,000. Accordingly, the cavity is rubble mined using the heating solvent and the cavity is enlarged using the lower temperature solvent thereby providing a space for further rubble mining. In this method it is preferred that high potassium chloride content ore is rubble mined and lower potassium chloride content ore mined to provide space for further rubble mining. This alternate method is particularly preferred since very high potassium chloride yield is possible without losing heat in the process.

In a second method of recapturing heat from the formation, a second cavity or series of cavities (heat sink cavities) are developed laterally adjacent the cavity fed by the heating solvent (heat source cavity). The heat sink cavity should be close enough to the heat source cavity to be in heat exchange relationship therewith and preferably the heat sink cavity have potassium chloride-rich strata in continuity with the heat source cavity. Since potassium chloride-rich deposits have a relatively high conductivity, heat easily flows laterally toward the heat sink cavity rather than flowing toward secondary competing heat sinks such as sand, silt, shale, and limestone, all of which may be overburden to the salt deposits to be mined. In some circumstances aquifers which are usually overburden and in almost all circumstances high sodium chloride content ore which is usually overburden and overburden to the deposits and which is economically impractical to mine can both be primary competing heat sinks, however. But, heat loss to these heat sinks, either through the floor, roof or wall of the heat source cavity, is obviated by creating a greater driving force to the heat sink cavity by maintaining a larger temperature drop thereto, if practical; however, when the heat sink cavity is very close to an aquifier, e.g., especially when the cavity is in open communication with the aquifier through which water is moving, this may not be possible.

Since heat recaptured by this second method is obviously primarily in the lateral direction, it is more expedient to have a cavity pattern such as several heat sink cavities around each heat source cavity and several heat source cavities around each heat sink cavity. Also, the heat source cavity will typically be insulated on its roof and floor to limit heat loss therethrough. Other cavity patterns may be apparent.

The lower temperature solvent is fed into the formation to develop the heat sink cavity at a time when the location where the cavity is to be developed is sufficiently heated. This may be anytime between 3 and 24 months after the initiation of the heat source cavity. The location of the heat sink cavity may also depend upon whether the cavities are to be connected. Connection of cavities is aided by the present invention since heat sink cavities have a tendency to "seek" heat source cavities. Hence, in cases where fracturing is impractical, the invention can substantially reduce the time required to connect cavities. Accordingly, the distance between heat sink and heat source cavities to be connected is generally about 20 to 100 meters; distance between cavities not to be connected, about 100 to 1000 meters. Shorter or longer distances may also be possible.

In this second method of heat recapture, the heat source and heat sink cavities can be mined simultaneously for long periods of time when the heat sink cavity is developed shortly after initiation of the heat source cavity. This gives rise to an added advantage of heat recapture by the second method which facilitates the determination and control of the rate of heat flow from the heat source cavity. By monitoring the temperature, composition and flow rates of solvents and solutions fed into and withdrawn from the cavities, adjustments designed to correct undesirable conditions can be made. For example, when the temperature of the solution withdrawn from the heat sink cavity become so low that precipitation of potassium chloride may plug withdrawal conduits, the temperature of the solvent fed to the heat source cavity may be raised. Alternately, the temperature of the solvent fed to the heat sink cavity can be raised, or the composition of the solvent or rate of solvent fed to the heat sink cavity can be adjusted. In cases where large quantities of heat given up to the formation is not recaptured by one method or by one heat sink cavity, another method may be used or additional heat sink cavities may be strategically located to recapture heat. Many other alternate methods become apparent whereby greater latitude in control and expedient use of heat are provided when using the second method of heat recapture.

Reference is now made to FIG. 1 which diagramically illustrates the mining of potassium chloride from its subterranean deposits 30 in accordance with one embodiment of the present invention. A bore hole is drilled to a mineable potassium chloride-lean strata 32 and lined with casing 1. Typically, the mineable strata will have a salt composition occuring in the following range:

| Composition | Percent by Weight |
|---|---|
| Potassium Chloride | 10 to 40 |
| Water Insoluble Clay | About 1 to 5 |
| Sulfates | Less than about 5 |
| Water Soluble Calcium and Magnesium Salts Such as Magnesium Chloride, Calcium Chloride | About 2 |
| Sodium Chloride | Remainder |

This mineable strata is typically between about 600 meters and 3000 meters deep and deeper such as deposits which are located in the Northern United States and Canada. The well is drilled through the potassium chloride rich strata, i.e., strata greater than 10 percent potassium chloride by weight, to a depth where the temperature is 60° C. and the potassium chloride content is less than about 10 percent by weight, preferably where the potassium chloride content is near 0 percent and located immediately below the potassium chloride rich strata. Water or an aqueous solution at about 60° C. and unsaturated with respect to sodium chloride is fed into the deposit through a tube 2 and withdrawn from the deposit through tube 3, both of which are disposed in the cased well bore 1, thereby creating a cavity 8 in the deposit.

A second cased bore hole 11 is drilled to the same mineable potassium chloride-lean strata 32 to a depth in communication with the strata of the first cavity and about 50 meters away. Water or an aqueous solution at about 60° C. and unsaturated with respect to sodium chloride is fed through tube 13 and into the salt deposit and withdrawn through tube 12, thereby creating cavity 18. Both, cavity 8 and 18 are grown upwardly by raising roofs 7 and 17, respectively, and grown laterally by feeding into the cavities an insulating inert fluid 6 and 16, respectively, according to the methods known in the art. Preferably, fluids 6 and 16 are also heat insulating. Inert insoluble solid materials 9 and 19 settle to the bottom of cavities 8 and 18, respectively. If materials 9 and 19 are not heat insulating then inert solid materials having a density greater than the solution and which are heat insulating are fed into the cavities 8 and 18.

At this point cavity 8 is heated by feeding thereinto solvent at 80° C. into tube 2 disposed in casing 1. Since the strata is low in potassium chloride content, the solvent is not substantially cooled because separate tubes are used for injecting and withdrawing and it dissolves essentially only sodium chloride. Hence, little heat is lost from solvent injected to solution withdrawn from the cavity. Consequently, cavity 18 is heated by heat given up to the formation between cavity 8 and cavity 18. Cavity 18, which is then continually fed 50° C. solvent, begins to grow toward cavity 8 and consequently connects therewith because sodium chloride, although not having a solubility which substantially increases with temperature, has a rate of dissolution which increases with increasing temperatures. Thus, the rate of growth toward cavity 8 is faster than its rate of growth in other directions. Alternately, connection is not attempted until the roofs of the cavities are raised into the potassium chloride rich strata whereby the increased solubility of potassium chloride is utilized for an even more rapid cavity connection. In either event, cavities 8 and 18 are grown laterally with insulating blanket 6 and 16 and insulating material 9 and 19 in place until the two cavities connect as shown in FIG. 2.

Reference is now made to FIG. 2 where tubings 2, 3, 12 and 13 are removed from casing 1 and 11, respectively, and hot solvent is fed into casing 1 and solution withdrawn from casing 11. Here roof raises are made into potassium chloride rich strata 31 and can be done utilizing a solvent with high temperature greater than that used in the illustration of FIG. 1 because the withdrawal casing 11 is better insulated from the feed casing 1. Hence, there is no loss of heat to withdrawn solution which is much cooler than the feed solution, especially when potassium chloride is being extracted from the deposit.

To effect a roof raise, a solvent at 105° C. and saturated with respect to sodium chloride and unsaturated with respect to potassium chloride can be fed into the top of cavity 8 with insulating fluid blanket 6 removed. Thus, the roof 7 of cavity 8 is raised into potassium chloride rich strata 31 rapidly since the solvent fed is less dense than the solution in the cavity. If the solvent is fed into the bottom of the cavity, the roof raise would be less rapid and the cavity shape would be slightly different, i.e., less of the "morning glory" shape familiar to those skilled in the art. However, use of morning glory shapes can be intentionally made and aid in cavity connections by the process of the present invention described above.

During the last increment of each roof raise, a cooler solvent at 60° C. and unsaturated with respect to sodium chloride and potassium chloride is fed into the cavity to recapture heat given up to the formation above the cavity. The heat and solvent insulating fluid blanket is then replaced in the cavity so that lateral cavity growth can be resumed.

A second cavity is developed such as in the manner the first cavity is developed and located in lateral communication with the strata of the first cavity, so that after full development of both cavities the walls thereof would be 100 meters apart. The solvent developing the second cavity is fed through casing 21 and solution is withdrawn through casing 22. An insulating fluid blanket 27 is fed into cavity 28.

A cooler solvent at 60° C. and unsaturated with respect to sodium chloride and potassium chloride is fed into cavity 28 as hot solvent at 105° C. is fed into cavity 8 for lateral growth. Heat is transferred, thereby, from cavity 8 to cavity 28 to supply heat for dissolution of potassium chloride and to heat the solution in cavity 28.

During the raising of roof 27 of cavity 28, solvent at 105° C. is used after removing insulating fluid blanket 26, as is used in raising roof 7 of cavity 8. Also, the cooler solvent at 60° C. is used for the last increment of roof raise to recapture heat given up to the formation above cavity 28. After each roof raise, the insulating fluid blanket 26 is replaced in cavity 28 to resume cavity growth laterally.

Cavities 28 and 8 may be alternated as heat source and heat sink cavities. Also, casings 1 and 21 may be alternated with casings 11 and 22 as feed and withdrawal conduits, respectively.

Reference is now made to FIG. 3 which illustrates a well cluster pattern of a minefield. Here cold cavities, i.e., cavities fed by cooler solvent, are surrounded by hot cavities, e.g., cavities fed by hotter solvents. Thus, heat is supplied and heat is recaptured from around each cold cavity except all cavities on the perimeter of the cluster pattern are cold to prevent heat from escaping from the clustern pattern area. Hot and cold cavities may be alternated but it is preferred that the solvents last introduced into the perimeter cavities are cold solvents.

The overall control of the cluster system can be easily effected by monitoring all withdrawal streams and adjusting the temperature, composition, and flow rates of feeding streams. The cluster is controlled so that the net inventory of heat is such that the final temperature is within 15° C. of the natural formation temperature while benefit is made from using hot solvents.

It should be understood that while the present invention has been described with reference to specific details and certain embodiments thereof, it is not intended that such details be regarded as limitations upon the scope of the invention except insofar as they are included in the accompanying Claims.

I claim:

1. A method of mining a water soluble salt from a subterranean formation containing a water soluble salt deposit comprising:

(1) feeding into the deposit through a bore hole in communication therewith a first aqueous solvent at a temperature above the deposit temperature to heat the deposit substantially above its natural temperature and dissolve salt from the deposit;

(2) withdrawing from the deposit first solvent enriched in salt;

(3) feeding into the deposit through a bore hole in communication therewith a second aqueous solvent at a temperature lower than the temperature of the first solvent, thereby dissolving a substantially increased amount of salt in excess of the amount of salt that would be dissolved by the second solvent in the absence of the increased deposit temperature and thereby recapturing heat from the deposit by the second solvent; and (4) withdrawing from the deposit the second solvent enriched in salt.

2. The method of claim 1, wherein the formation is heated at least 2° C. above its natural temperature.

3. The method of claim 1, wherein the first solvent at a temperature above 100° C. is fed into the deposit.

4. The method of claim 1, wherein the net formation temperature is within 15° C. of the natural formation temperature.

5. The method of claim 1, wherein the water soluble salt deposit is a mixture of potassium chloride, sodium chloride, and a minor amount of salt and insoluble impurities.

6. The method of claim 1, wherein the second solvent is fed into a same cavity developed by the first solvent.

7. The method of claim 1 wherein the second solvent develops a second cavity in heat exchange relationship with a first cavity developed by the first solvent.

8. The method of claim 1, wherein the first solvent at a temperature between 50° C. and 100° C. is fed into the deposit.

9. The method of claim 6, wherein the first and second solvents are fed into the deposit during a roof raise.

10. The method of claim 6, wherein the first and second solvents are fed into a potassium chloride-rich deposit which is rubble mined.

11. The method of claim 7, wherein the first solvent is fed into the first cavity and the second solvent is fed into the second cavity during lateral growth.

12. The method of claim 11, wherein the first and second cavities are connected.

13. A method of mining potassium chloride from a subterranean formation containing a potassium chloride-rich deposit comprising:

(1) feeding into the deposit through a bore hole in communication therewith a first aqueous solvent at a temperature above the deposit temperature to heat the deposit at least 2° C. above its natural temperature and dissolve potassium chloride from the deposit;

(2) withdrawing from the deposit first solvent enriched in potassium chloride;

(3) feeding into the deposit through a bore hole in communication therewith a second aqueous solvent at a temperature lower than the temperature of the first solvent, thereby dissolving a substantially increased amount of potassium chloride in excess of the amount of potassium chloride that would be dissolved by the second solvent in the absence of the increased deposit temperature and thereby recapturing heat from the deposit by the second solvent; and (4) withdrawing from the deposit second solvent enriched in salt.

14. The method of claim 13, wherein the first solvent at a temperature above 100° C. is fed into the deposit.

15. The method of claim 14 wherein the net formation temperature is within 15° C. of the natural formation temperature.

16. The method of claim 13, wherein the second solvent is fed into the same cavity developed by the first solvent.

17. The method of claim 13, wherein the second solvent develops a second cavity in heat exchange relationship with the cavity developed by the first solvent.

18. The method of claim 16, wherein the first and second solvents are fed into the cavity during a roof raise.

19. The method of claim 16, wherein the first and second solvents are fed into a deposit which is rubble mined.

20. The method of claim 17, wherein the two cavities are connected.

21. A method of mining potassium chloride from a subterranean formation containing potassium chloride, sodium chloride, and a minor amount of water soluble salt and insoluble impurities comprising:

(1) feeding into the deposit through a first bore hole in communication therewith a first aqueous solvent at a temperature above the deposit temperature to heat the deposit between 2° C. and 15° C. above its natural temperature and dissolve salt from the deposit;

(2) withdrawing from the cavity through a second bore hole in communication therewith first solvent enriched in salt;

(3) feeding into the deposit through a bore hole in communication therewith a second aqueous solvent at a temperature lower than the temperature of the first aqueous solvent, thereby dissolving a substantially increased amount of salt in excess of the amount of potassium chloride that would be dissolved by the second solvent in the absence of the increased deposit temperature and thereby recapturing heat from the deposit by the second solvent; and (4) withdrawing from the deposit second solvent enriched in salt.

22. The method of claim 21, wherein the first solvent at a temperature above 100° C. is fed into the deposit.

23. The method of claim 22, wherein the second solvent is fed into the cavity developed by the first solvent.

24. The method of claim 22, wherein the second solvent develops a second cavity in heat exchange relationship with the cavity developed by the first solvent.

25. The method of claim 22, wherein the first solvent is an aqueous solution saturated with respect to sodium chloride and unsaturated with respect to potassium chloride.

26. The method of claim 1, 13 or 21, wherein the first and second solvents are fed into the same bore hole.

* * * * *